United States Patent [19]

Ekornes

[11] Patent Number: 4,984,846

[45] Date of Patent: Jan. 15, 1991

[54] ARRANGEMENT IN AN ADJUSTABLE CHAIR

[75] Inventor: Jostein Ekornes, Ikornnes, Norway

[73] Assignee: J. E. Ekornes A/S, Norway

[21] Appl. No.: 372,381

[22] PCT Filed: Oct. 14, 1988

[86] PCT No.: PCT/NO88/00079

§ 371 Date: Jun. 16, 1989

§ 102(e) Date: Jun. 16, 1989

[87] PCT Pub. No.: WO89/03648

PCT Pub. Date: May 5, 1989

[30] Foreign Application Priority Data

Oct. 19, 1987 [NO] Norway ..... 874362

[51] Int. Cl.[5] ..... A47C 1/02

[52] U.S. Cl. ..... 297/317

[58] Field of Search ..... 297/317, 318, 321, 322

[56] References Cited

U.S. PATENT DOCUMENTS

| | | | |
|---|---|---|---|
| 2,271,925 | 2/1942 | Niles | 297/317 |
| 2,522,246 | 9/1950 | Armstrong | 297/318 |
| 4,452,486 | 6/1984 | Zapf et al. | 297/317 X |
| 4,504,090 | 3/1985 | Goldman | 297/317 X |
| 4,607,883 | 8/1986 | Tzu-Chun | 297/317 |
| 4,660,884 | 4/1987 | Terui et al. | 297/317 |

FOREIGN PATENT DOCUMENTS

| | | | |
|---|---|---|---|
| 96273 | 12/1983 | European Pat. Off. | 297/317 |
| 2104944 | 8/1972 | Fed. Rep. of Germany | 297/317 |
| 2359440 | 11/1973 | Fed. Rep. of Germany | 297/317 |
| 72865 | 8/1987 | Finland | 297/317 |
| 1449822 | 7/1966 | France | 297/317 |
| 67235 | 4/1985 | Japan | 297/317 |
| 125836 | 11/1972 | Norway | 297/317 |
| 7315378 | 9/1976 | Sweden | 297/317 |
| 470122 | 8/1937 | United Kingdom | 297/317 |

*Primary Examiner*—Peter A. Aschenbrenner

*Attorney, Agent, or Firm*—Nolte, Nolte and Hunter

[57] ABSTRACT

The invention relates to a device in a chair, especially an adjustable chair (1*aa*) having an articulation means (7) between a seat member (3) a back rest member (8*a*), so as to allow an alteration of the angular position therebetween, the alteration taking place by a pivoting said back rest member (8*a*) around a pivoting point (8) whilst said seat member (3) is displaced along a predetermined sliding path. The invention is characterized in that the device comprises one or more curved sliding means (1), the radius of curvature (R) of said sliding means (1) or the center (4) thereof being arranged in accordance with given functional properties of said chair (1*aa*), which in turn means that for example an increase of the tangential angle ($\alpha$) of the sliding means (1) may compensate for the increased weight from a person on the back rest member (8*a*) as the latter is taking a more reclined position, for thereby providing a chair which is in balance in all positions and rendering smaller friction than compared with prior art models.

13 Claims, 4 Drawing Sheets

ARRANGEMENT IN AN ADJUSTABLE CHAIR

FIELD OF THE INVENTION

The present invention relates to a device in a chair, especially an adjustable chair comprising an articulation means between a seat member and a back rest member, so as to allow an alteration of the angular position therebetween.

PRIOR ART

A chair of this type is for example known from NO patent specification No. 125 836.

From SE published and printed specification No. 388 118 there is known such a chair having a back rest which is linked together with a seat member, the seat member on its lower side being equipped with straight metal hoops which can pass through a bearing cup provided fixedly on the chair frame, but pivotably in relation thereto. In order to maintain the chair in the sitting position having the back rest in an upright position there is on the metal hoop provided a wedge-shaped element wedging in the opening of the bearing cup.

From Finnish printed and published specification No. 72865 there is known a device for regulating and locking the back member of a chair, there being provided on the seat member a straight guiding rod which at its one end is linked together with the front portion of the seat, and which at its other end freely protrudes through a recess in a lockable bearing cup. The locking means comprises a handle which with its one end can be pivoted into and out of the recess in the bearing cup for thereby catching or releasing the guiding bar in the recess.

From German printed and published specification No. 2 104 944 there is known a flip up device which can be used in connection with larger and heavier chairs, for example chairs in cosmetic treatment, dentist chairs, etc., there being for the various slanted positions of the chair achieved the same point of gravity for the chair and the user relative to the subframe of the chair. There is used a curved guide rail which can move between rollers, and which resides in a box-shaped house mounted on the seat member of the chair. In various positions of the back rest member and of a person, the chair will adjust itself to a position in which the point of gravity is the same, since the seat member then will adjust itself such that the point of gravity will be right below the seat member.

However, nothing is said in this German publication about an articulation means between the seat member and the back rest member, let alone a pivot point on the back rest member around which the back rest member can be pivoted by the user in order to bring the back rest member to various angular positions, i.e. how various moments will be exercised by the body of the user depending on the inclination of the back rest member related to said pivot point, and how the seat member is to be displaced along a specific guiding path.

From EP-O No. 096 273-A3 there is known a chair, wherein the back rest member can be pivoted about a fixed point on the chair frame, the back rest member at the bottom being linked to the seat which can slide along a guide bearing. In a given embodiment the guide bearing may take the form of curved guiding elements which are mounted on the seat, and which are guided in corresponding tracks provided stationary on the chair frame.

From U.S. Pat. No. 4,607,883 and U.S. Pat. No. 4,660,884 there are also known chairs having an articulation means between a seat member and a back rest member. However, neither are there here given any instructions for how it is possible with simple expedients to provide a double sliding path rendering larger options as regards versatility in the application facilities

BRIEF DISCUSSION OF THE INVENTION

In view of this prior art an object of the present invention is to provide a device rendering larger possibilities for adjusting the force necessary for changing the relative position between seat member and back rest member, an objective of the invention also being to give instructions for a regulating mechanism which further improves the operational facilities of the chair.

In other words, the invention aims at providing a chair which so to say independently of the geometry of the chair brings forth a predetermined resistance when the chair is adjusted, i.e. a resistance which is most favourable for the user when changing the sitting position from an upright position to a backwardly inclined or lowered position.

This is achieved with a device of the type as stated in the preamble, which according to the invention is characterized in that the device comprises one or more curved sliding means, the radius of curvature of said sliding means or the center thereof being arranged in accordance with given functional properties of the chair, it being observed that a smaller radius of curvature or a corresponding shaper curve of the sliding means involves a larger variation from a minimum value to a maximum value of the tilting angle, i.e. the angle between a horisontal plane and a tangent to the curved sliding means substantially in the area of a sliding means support, when said sliding means is displaced via said sliding means support upon adjustment of the back rest member from a raised position to a backwardly lowered position.

In other words, the invention is based on the fact that the notional center of the curved sliding means can be adjusted up from or down towards the chair, a lowering including a reduction of the radius of curvature of the sliding means and therefore a large difference in the slanting angle of the sliding means when the back rest member is moved from a raised to a lowered position.

Appropriately, the present device may be included in an adjustable chair, such that a displacement of the notional center of the sliding means rearwardly towards the back rest member, involves an increase in the total angle, i.e. an overall steeper angle of the sliding means in all positions of the back rest member.

BRIEF DISCUSSION OF THE DRAWINGS

FIG. 1 is a diagrammatic sideview of an embodiment of a chair of the present type, wherein a first embodiment of the device according to the invention has been implemented.

FIGS. 2 and 2*a* are views similar to FIG. 1, but illustrate the chair in a reclined position.

FIGS. 3 and 3*a* illustrate on a larger scale details of the friction and height adjustment means.

FIG. 4 is a view as seen from the front of the chair illustrated in FIGS. 1, 2 and 2*a*.

DESCRIPTION OF PREFERRED EMBODIMENTS

Figure 1:
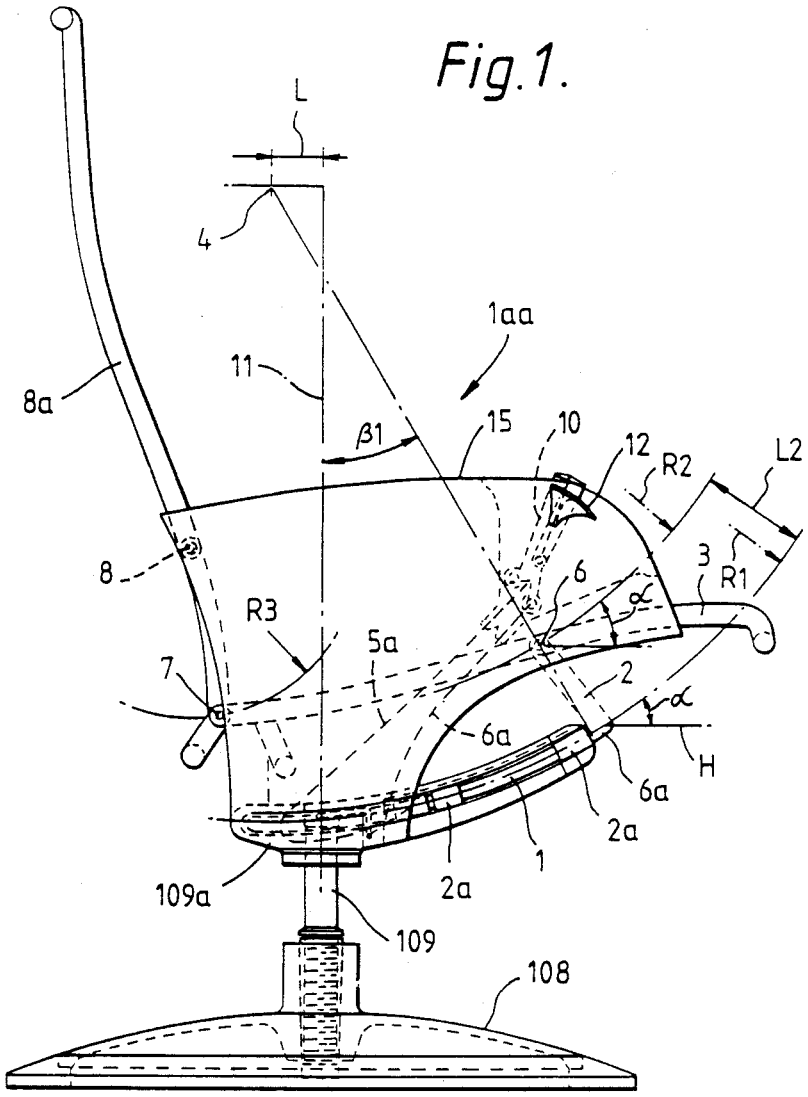
Figure 2:
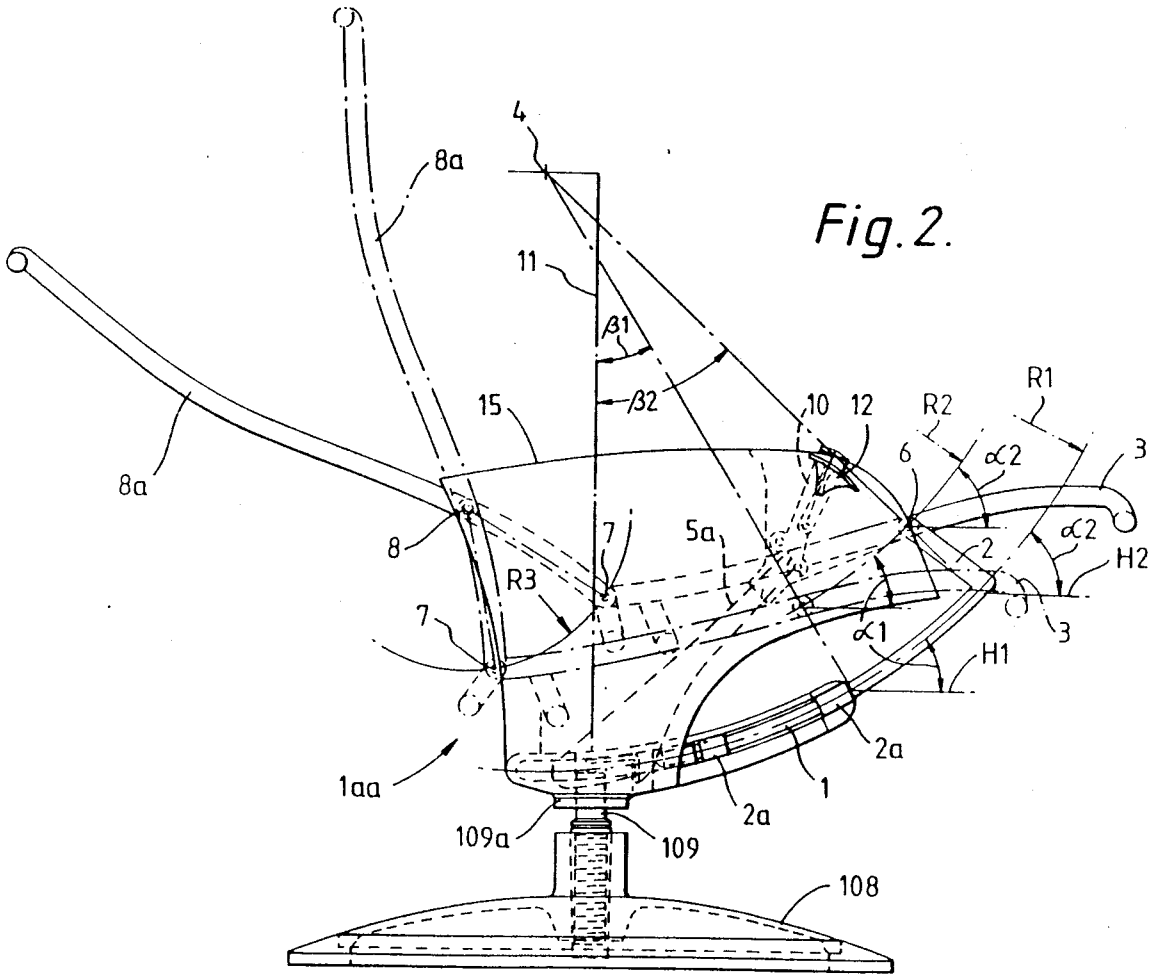
Figure 2A:
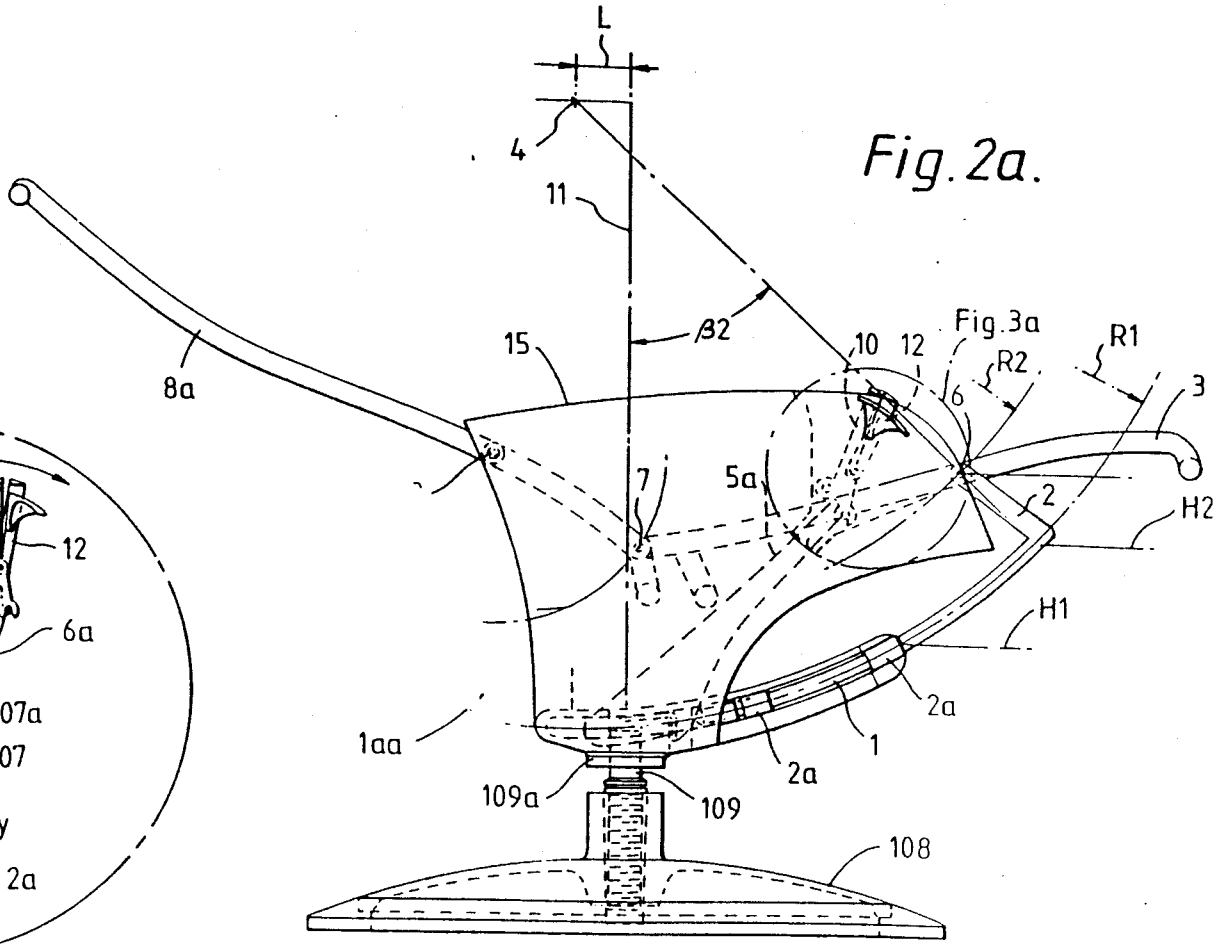

With reference to FIGS. 1, 2 and 2*a* which illustrate an embodiment of a chair of the present adjustable type, it should be noted that FIG. 1 illustrates an embodiment of the present chair, which here is generally designated by reference numeral 1*aa*, and which is shown in an upright position, i.e. in which position a back rest member 8*a* takes a substantially upright position and a the seat member 3 takes a substantially horizontal position, whereas FIGS. 2 and 2*a* illustrate a reclined or stretched-out position of the seat member and the back rest member, the seat member 3 still having a substantially horizontal position but the back rest member 8*a* having been displaced from its previous erect position to an approximately slightly slanted horizontal position.

The embodiment of the adjustable chair 1*aa* according to the invention, in which the present device can find its application, comprises a back rest member 8*a* and a seat support member 3, the back rest member 8*a* and the seat member 3 being interconnected to each other by means of an articulation means 7 for enabling alternating angular positions between said back rest member 8*a* and seat support member 3. Said members 8*a*, 3 are provided on a subframe 109*a* which in turn is supported on an adjustable column 109 provided on a base plate 108.

On the subframe 109*a* there are provided slide bearings 2*a* through which can be displaced one or more sliding means 1, taking the form of one or more curved arcs, preferably circular arcs, which at its or their front end is provided with an arm element 2 extending from the sliding means 1 towards the seat support member 3, the sliding means 1 and its arm 2 preferably substituting an intergral unit, but being connected to the seat support member 3 through a second articulation means 6.

Figure 4:
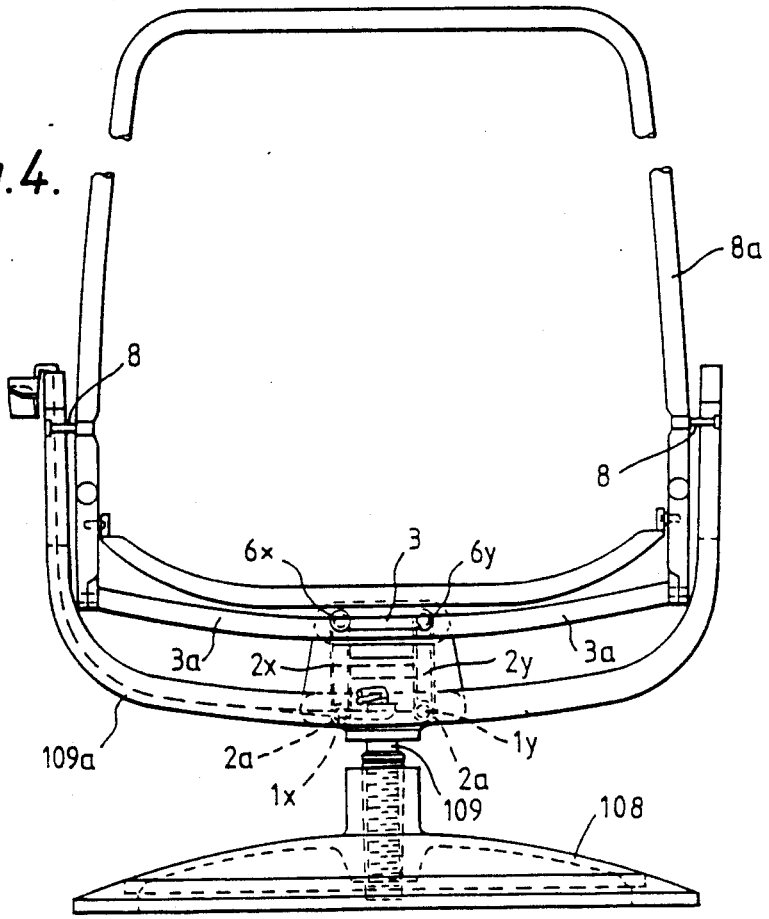

As further indicated, especially in FIG. 4, the sliding means 1 here comprise two substantially parallel sliding elements, but it is to be understood that fewer or lesser sliding elements can of course be used.

The center 4 of the curved sliding means 1 is indicated as a notional point 4 in FIGS. 1, 2 and 2*a*, it being understood that if the sliding means 1 are provided with a constant radius of curvature, this notional center 4 will be a fixed point for this type of embodiment.

The function of the chair 1*aa* is such that when the top of the back rest member 8*a* is pressed backwards or forwards, or the seat member 3 is pushed forwards or rearwards, then the back rest member 8*a* will turn around the pivot point 8 which is stationary in relation to the subframe 109*a*. The articulation means 7 between the seat member 3 and the back rest member 8*a* will then move along a substantially circular path having its center in the pivot point 8, and a radius designated R3.

The second articulation means 6 on the seat member 3 will due to its connection with the arm 2 integral with the sliding means 1, move along a circular path having its notional center at the previous discussed point 4, but having a radius of curvature designated R2.

The sliding means 1 which controls the movement of the seat member 3, will also in this case when the sliding means 1 represent circular arcs, have the center of radius located at the same point 4, but the distance therefrom to the sliding means 1 will be a radius designated R1.

It is to be understood that the sliding means 1 are guided in said slide bearings 2*a* which are more or less stationary arranged in relation to the subframe 109*a*, but have associated therewith friction means 5 which are also arranged relative to the subframe 109*a* and can be operated by the user through an operating means 12 connecte through a transmission 5*a* from an appropriate place, for example on an arm rest 15.

When the back rest member 8*a* is displaced backwards as illustrated in FIGS. 2 and 2*a* the tilting angle $\beta$, i.e. the angle between a vertical plane 11 and a radius R1 or R2 running from the notional circular point 4 to the articulation point 6 on the seat member 3 will increase from $\beta 1$ to $\beta 2$.

At the same time the angle $\alpha$, i.e. the angle between a horizontal plane H and a tangent to the curved sliding means 1 substantially in the area of the second articulation point 6 between the arm 2 of the sliding means 1 and the seat member 3, will increase from $\alpha 1$ to a larger angle $\alpha 2$.

The advantages of introducing such a sliding means 1 which will have its tangential angle $\alpha$ changed depending on the angular position between the seat member and the back rest member, is to the fact that the force required by the user to effect this change in angular position, can be regulated depending on whether the user is to carry out an inclining or reclining movement. When the user is sitting in a substantially errect position, i.e. with an approximately 90° inclined position between back and seat, the embodiment according to FIGS. 1, 2 and 2*a* will render a small tangential angle $\alpha$ for the sliding means 1 in the area of the articulation means 6 or in the area of the slide bearings 2*a*, which is to the fact that the user have to exercise a relatively small force in order to change the angular position between seat member and back rest member, which is favourable since it is, in connection with prior art adjustable chairs, usually heavy to move the chair when sitting in an upright position.

In reclined position of the chair 1*aa*, i.e. when the back rest member 8*a* is fully lowered, it is usually, in connection with prior art adjustable chairs, too easy to perform a backwards tilting movement, but in accordance with the present invention and the present arrangement, the tangential angle $\alpha$ of the sliding means 1 will become larger the larger the angle of inclination of the back rest member 8*a* will be. This in turn involves that the seat member 3 has to be lifted more and more steeper as the back rest member 8*a* is lowered, and this raising of the seat member for example from a level H1 to a level H2, including the lower part of the body of the user, will compensate for the weight of the back of the user resting on the back rest member 8*a*.

In other words, the change in tangential angle $\alpha$ of the sliding means 1 will compensate for the increased effect of the lever arm represented by the back rest member 8*a* and the upper part of the body of the user, the weight of which will create a moment by pressing against the upper part of the back rest member 8*a* with an increased arm proportional to the increasing tilting angle of the back rest member (8*a*).

As an overall concept this variation in tangential angle $\alpha$ and inclination angle $\beta$ will bring forth a chair according to the present invention, which in all positions will function in a balanced state, provided the friction means are appropriately adjusted, this balanced position rendering a relatively lower friction than compared with prior art adjustable chairs of any model.

An important feature of the present invention is to the fact that if it is desired to change the individual functional properties of the chair, this can be done by reducing or increasing the length of the radius R2, i.e. reduce or increase the radius of curvature of the sliding means 1. In accordance therewith there is then achieved a small or a large difference in the tangential angle of the sliding means in the vertical and the reclined position of the back rest member 8*a*. Likewise, by increasing or reducing the distance L between the pivoting point or the notional center 4 of the sliding means 1 and the vertical line 11 extending through the central line of the support column 109 of the chair 1*aa*, it is possible to increase or reduce the average tangential angle of the sliding means 1.

Experience has indicated that in such an adjustable chair including a friction means 5 it is more easy to achieve an appropriate adjustment of the friction and a smooth sliding during adjustment of the chair if the chair is provided with a sliding means having a relatively long extention, and also to achieve a smooth sliding velocity along the slide bearings as the chair is having its angular position altered. A disadvantage which may be experienced in this connection is a large movement of the seat member and a large difference in level of the seat in the various positions.

In the present design the length and the curvature of the sliding means can be regulated without involving an increase in the length of movement of the seat member. This is mainly achieved by giving the sliding means 1 a relatively large radius of curvature and by mounting said sliding means below the seat member 3. By this arrangement it is also achieved a difference between the adjusting velocity of the seat member 8*a* and the sliding means 1 by keeping the angular velocity of the tilting angle $\beta$ constant, but making the radius R1 of the sliding means larger than the radius R2 of the seat member 3. By increasing the difference L2 between R1 and R2 the difference in adjusting velocity and sliding length at a point on the sliding means 1 and the seat member 3, for example at point 6*a* and point 6, respectively, will increase.

By systematically changing said distances and numeric values, as well as by changing the radius R3 and the distance between the first articulation means 7 and the second articulation means 6, it is possible to manufacture a chair having very favourable sliding properties and functioning in a balanced mode with very low friction, it also been possible to produce all desired relations between the operating force which has to be effected in the vertical and declined position of the chair, respectively.

Figure 3A:
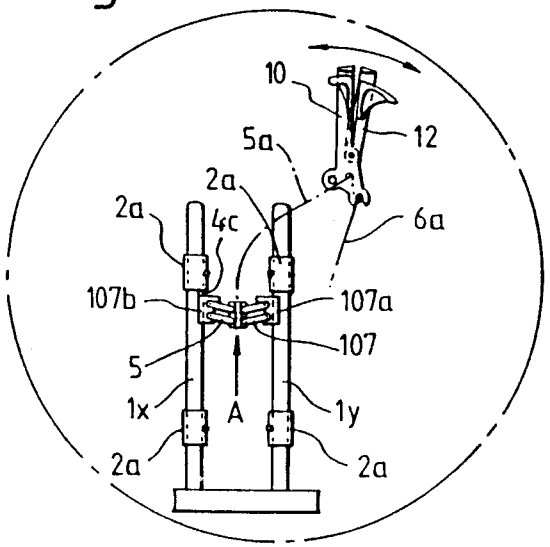
Figure 3:
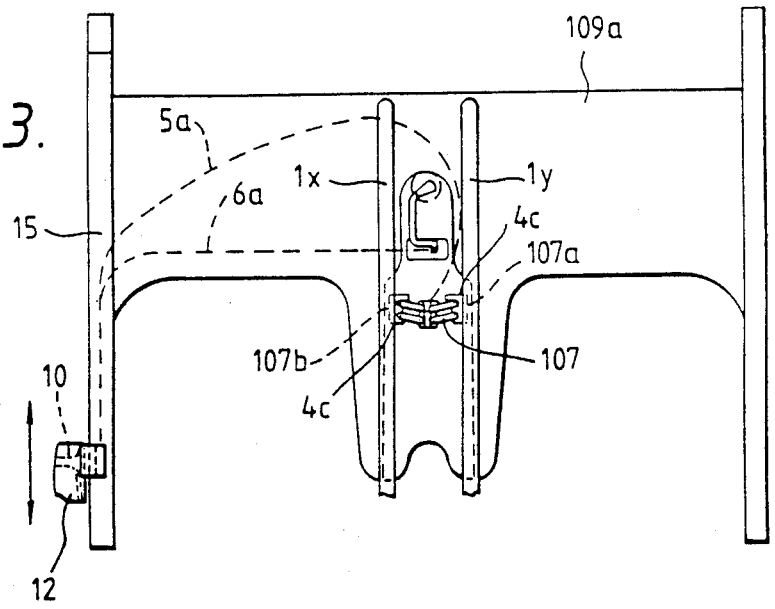

In the present case there have been used two sliding means 1*x* and 1*y* as illustrated in FIGS. 3, 3*a* and 4, the center of each sliding means having its own notional center as discussed previously. Whether there are used two or more or even one sliding means, the chair will function so as to allow varying operating characteristics by moving said centers up from or down towards the seat member, a reduction of the radius of the sliding means meaning that there is achieved a large difference in the tangential angle of the sliding means in the erected position and the declined position of the back rest member, respectively.

It is to be understood that the friction means can be made as a hidden arrangement, it being observed that no jamming should be risked at any place between moving parts.

In FIGS. 3 and 3*a* there is illustrated a suggested braking mechanism in which a wire 5*a* in a stocking, as indicated in the drawings, is contemplated used for compressing the friction means 5 in the direction of the arrow A. By pressing said friction means 5 a pressure is transferred against the two curved sliding means 1*x*, 1*y*, and this preasure is to be regulated through the operating means 12 on the arm rest 15. It is also possible to use other forms for locking mechanisms. It is also to be understood that the chair can operate satisfactorily by using only one sliding means and a friction means pressing on the outside of said single sliding means.

The friction means 5 thus comprises an elastic element 107 which through a force in the direction of the arrow A is subjected to a structural change so as to expand substantially in a direction perpendicular to the direction of the arrow A, for thereby pressing a breaking block 107*a*, 107*b* against a breaking surface 4*c* of the sliding means 1*x*, 1*y*, respectively.

The embodiment of a chair illustrated in the drawings is also equipped with an adjustable supporting column 109, and the operation thereof is indicated by reference numeral 10, said means preferably being arranged on the arm rest 15, and operating trough a wire 6*a*.

In FIG. 4, which is a view as seen from the front of the chair according to FIGS. 1, 2 and 2*a* it appears that the seat supporting member 3 is comprised by a transverse member 3*a* which at its center portion is provided with two of the previously discussed second articulation means 6*x*, 6*y*, each of which is connected to an arm element 2*x* and 2*y*, respectively, merging into a curved sliding means 1*x* and 1*y*, respectively, which in turn are supported in a slide bearing 2*a* and 2*b*, respectively, substantially stationary affixed to the subframe 109*a* of the chair 1*aa*.

In such a structure the seat member 3 will consequently move along a first circular path having a first radius R2, whereas the sliding means 1*x*, 1*y* which are provided at a distance L2 from the seat member 3 will move along a second radius R1 which is larger than said first radius R2.

It is to be understood that the shape of any sliding means according to the present invention can have a varying curvature along its extention, for example including a steeper curvature at its rear end, i.e. at the end closest to the back rest member of the chair. In connection with such an embodiment including a variable curvature of the sliding means, it is to be understood that the slide bearings carrying and guiding said variable curvature sliding means must be arranged pivotably around an axis substantially perpendicular to the sliding means.

It is to be understood that in any embodiment, whether one, two or more parallel sliding means are used, each sliding means could be supported by two shorter guiding means or bearing means arranged at an appropriate mutual spacing. Depending on whether the sliding means is or are given a varying curvature, said single guiding means or multiple guiding means may be arranged stationary and pivotably, respectively, relative to a fixed structure of the chair.

Further, it is to be understood that the size of the first radius R2 may be in the range of 0.5–1.5 m, whereas the length of the second radius R1, could be 0.3–0.5 m larger.

In other words, it is possible within the scope of the present invention to arrange a curved sliding means 1 below the path followed by the seat member 3 during the adjustment thereof, and to regulate the length and the curvature of said sliding means in a simple and practical way in accordance with the various operating properties of the different chairs.

I claim:

1. A device in a chair having a back member, a seat member, frame means for supporting said back and seat members, fixed pivot means between said back and said frame means for mounting said back member for pivotal movement thereabout, slide means between said frame means and said seat member for mounting said seat member for sliding forward and rearward in substantially horizontal positions, first articulation means comprising first movable pivot means for pivotally interconnecting said back and seat members for altering the relative angular positions therebetween from and to erected and recline positions and for pivoting said back member between vertical and rearwardly inclined positions with said first movable pivot means movable along a radius fixed by said fixed pivot means and said slide means the improvement in which said slide means comprises curved sliding means mounted below said seat member a predetermined distance, second articulation means comprising second movable pivot means interconnecting said curved sliding means and said seat member for altering the relative angular positions therebetween and for pivoting said seat member along said substantially horizontal positions with said slide means moving along a radius larger than the radius along which said first articulation means moves.

2. Devices as claimed in claim 1, in which an arm rest at the side of said seat member forms a part of said frame means and extends above said seat member and in which the curved sliding means have a radius of curvature which is larger than the distance from the level of the seat member to the level of said arm rest.

3. Device as claimed in claim 1 or 2, in which the sliding means have a radius of curvature, a notional center thereof being so high above the seat member that a tangential angle of the sliding means is changed within relatively small limits when the seat member is displaced from an erected to a more reclined position.

4. A device as claimed in claim 1 or 2, in which the sliding means have a radius of curvature having a notional center which is so close to the back rest member that a tangential angle of the sliding means changes rapidly towards a higher value when the seat member is displaced by pivoting the back rest member from an erected to a more reclined position.

5. A device as claimed in claim 3, in which the radius of curvature of the sliding means passes through a notional centre which is located a distance behind a vertical plane through a central column of the chair, a further displacement of said notional center rearwardly from said vertical plane resulting in an overall increase of the tangential angle of said sliding means in all positions of said chair.

6. A device as claimed in claim 4, in which the radius of curvature of the sliding means passes through a notional center which is located a distance behind a vertical plane through the central column of the chair, a further displacement of said notional center rearwardly from said vertical plane resulting in an overall increase of a tangential angle of said sliding means in all positions of said chair.

7. Device as claimed in claim 1, in which the sliding means comprises one or more curved sliding rails which at their front end are each provided with a connection arm which arms are joined to said seat member by means of said second articulation means.

8. Device as claimed in claim 1, in which the shape of the sliding means has a varying curvature along its extension.

9. Device as claimed in claim 1, in which the length of said first radius is in the range 0.5 to 1.4 meters, whereas the length of the second radius is approximately 0.3 to 0.5 meters larger.

10. Device as claimed in claim 1, in which the device also comprises a first operating mechanism for operating a friction element influencing said sliding means, and comprising for example a cable extending from said operating mechanism.

11. Device as claimed in claim 10, in which the friction element comprises an elastic element which under the influence of a force is subjected to a structural change for expanding in a direction towards a breaking surface of the sliding means.

12. Device as claimed in claim 11, in which the elastic friction element is arranged between two sliding means and by the influence of a pressure initiated by said first operating mechanism will have its centre zone compressed for thereby pressing the side zones towards a respective breaking surface of the sliding means.

13. Device as claimed in claim 12, in which the device also comprises a gas column carrying said sliding means and a second operating mechanism for operating said gas column.

* * * * *